United States Patent [19]

Berthold et al.

[11] Patent Number: 4,760,015

[45] Date of Patent: Jul. 26, 1988

[54] STABILIZATION OF A PHOTOGRAPHICALLY PRODUCED SILVER IMAGE USING AN AMINO-1,2,4-TRIAZOLE

[75] Inventors: Werner Berthold, Leverkusen; Günther Mahlberg, Bergisch Gladbach; Paul Marx, Leverkusen; Hans Öhlschläger, Bergisch Gladbach, all of Fed. Rep. of Germany

[73] Assignee: Agfa Gevaert Aktiengesellschaft, Leverkusen-Bayerwerk, Fed. Rep. of Germany

[21] Appl. No.: 37,931

[22] Filed: Apr. 13, 1987

[30] Foreign Application Priority Data

Apr. 23, 1986 [DE] Fed. Rep. of Germany ..... 3613622

[51] Int. Cl.[4] ..... G03C 5/24

[52] U.S. Cl. ..... 430/428; 430/429; 430/432; 430/463; 430/248; 430/965

[58] Field of Search ..... 430/372, 428, 429, 463, 430/965, 432, 233, 248

[56] References Cited

U.S. PATENT DOCUMENTS

| | | | |
|---|---|---|---|
| 3,577,240 | 5/1971 | Nishio et al. | 430/463 |
| 3,674,481 | 7/1972 | Konig et al. | 430/233 |
| 4,351,896 | 9/1982 | Atland et al. | 430/428 |
| 4,404,390 | 9/1983 | Atland et al. | 430/428 |
| 4,615,970 | 10/1986 | Kojima et al. | 430/372 |

*Primary Examiner*—Paul R. Michl
*Assistant Examiner*—Patrick A. Doody
*Attorney, Agent, or Firm*—Connolly and Hutz

[57] ABSTRACT

Photographically produced black-and-white images (silver images) are stabilized against subsequent destruction of the silver image, in particular against the occurrence of so-called microspot defects, by treatment of the finished silver image with an aqueous after-treatment bath containing an amino-1,2,4-triazole.

4 Claims, No Drawings

STABILIZATION OF A PHOTOGRAPHICALLY PRODUCED SILVER IMAGE USING AN AMINO-1,2,4-TRIAZOLE

This invention relates to a process for the stabilization of photographic silver images by treatment with an aqueous after-treatment bath.

In photographic silver images which have been produced by the development and fixing of exposed silver halide emulsion layers, the tone of the print in some cases shifts in the course of time from black to brown or yellow over the whole area of the print or parts thereof.

This change in tone may be due to conversion of the silver image into silver sulphide, for example if the print is not washed sufficiently thoroughly after it has been fixed with sodium thiosulphate. An equally troublesome change in tone may be produced by the action of oxidizing gases on photographic silver images. Oxidation of the image silver gives rise to water-soluble silver salts which may diffuse into the material. Photolysis of these soluble silver salts may result in the formation of finely divided colloidal silver which is yellow to reddish brown in colour or the formation of brown silver compounds. Such changes in the finished photographic silver image in many cases occur pointwise in the form of so-called microspot defects.

The term "microspot defects" is used for defects of a microscopic size in photographic black-and-white silver halide recording materials. These defects are characteristically circular and generally yellow to reddish brown in colour. When they occur in photographic silver halide recording materials, these microspot defects are also referred to as "red spots", "microscopic spots", "drying or ageing spots" or "microscopic defects or spots". These microspots have been described in some detail, for example in a work by R. W. Henn and D. G. Wiest entitled "Microscopic Spots in Processed Microfilm: Their Nature and Prevention" published in "Photographic Science and Engineering, 1963, page 257; in a work by R. W. Henn, D. G. Wiest and B. D. Mack entitled "Microscopic Spots in Processed Microfilm: The Effect of Iodide" published in "Photographic Science and Engineering", 1965, page 167 and in a work by C. I. Pope entitled "Blemish Formation in Processed Microfilm", published in "Journal of Research of the National Bureau of Standards A. Physics and Chemistry", Volume 72A, 1968, pages 251 to 259. The microspot defects frequently occur in the form of concentric rings which may vary in size and are particularly troublesome in the continuous tones of the silver images.

There has been no lack of attempts to prevent or reduce these undesirable changes in photographically produced silver images, for example by more thorough washing to remove the chemicals used for processing the imagewise exposed photographic recording materials or by storing the processed materials, i.e. the completed silver images, under standardized atmospheric conditions.

Various classes of compounds have already been described for stabilizing the finished silver images.

These include both cyclic and acyclic thiosemicarbazides (DE-A-20 00 622), heterocyclic mercapto and thione compounds from the series of tetrahydropyrimidines, thiazines and tetrazines (DE-A-20 13 423), organic and inorganic thiocyanates (DE-A-22 18 387) and isothioureas (U.S. Pat. No. 4,500,632). These compounds, however, are not entirely satisfactory in practice since they either have insufficient stabilizing action or adversely affect the photographic properties of the layers.

Other processes are known in which the stabilizing additives are directly incorporated in the photographic silver halide material. The incorporation of polyvinyl imidazole, for example, is described in DE-A-31 51 182 (GB-A-2 090 991) while the incorporation of sulphoalkyl substituted hydroquinones is described in GB-A-1 156 167.

These substances, however, require to be used at relatively high concentrations of, say, 0.5 g/m$^2$ if they are to have a sufficient stabilizing effect. The compatibility of polyvinyl imidazole with silver halide emulsions, wetting agents, stabilizers, developers and auxiliary developers, however, is highly critical and high concentrations of the stabilizing additives in the protective layer reduce the gloss.

A process for stabilizing photographically produced silver images which does not have the above-mentioned disadvantages has now been found. It entails the use of an after-treatment bath containing an amino-1,2,4-triazole as a stabilizing compound.

The present invention relates in particular to a process for the stabilization of a photographically produced silver image by treatment of the finished silver image with an after-treatment bath, characterised in that the after-treatment bath contains an amino-1,2,4-triazole corresponding to the following formula I

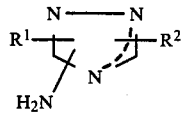

I wherein $R^1$ and $R^2$, which may be identical or different, denote H, $NH_2$, alkyl, alkenyl, cycloalkyl, aryl, alkoxy, alkylthio, alkylsulphonyl, sulphamoyl, acyl, SH or a heterocyclic group.

In Formula I, an alkyl group represented by $R^1$ or $R^2$ may be straight chained or branched and preferably contains 1 to 4 carbon atoms. Examples include methyl, ethyl and isopropyl. Such an alkyl group may also be substituted, e.g. by hydroxyl, alkoxy, alkylthio, carboxyl, carbalkoxy or amino. Vinyl and allyl are examples of alkenyl groups. Cyclohexyl is an example of a cycloalkyl group. Phenyl is an example of an aryl group and may be substituted, e.g. with halogen, alkoxy, alkylthio, acylamino or nitro.

The alkoxy, alkylthio and alkylsulphonyl groups represented by $R^1$ or $R^2$ preferably contain alkyl groups having 1 to 4 carbon atoms; preferred examples are methoxy, methylthio and methylsulphonyl. An example of a sulphamoyl group is N,N-dimethylsulphamoyl. An acyl group is preferably derived from an aliphatic carboxylic acid with up to 4 carbon atoms; acetyl is an example of such an acyl group.

Heterocyclic groups represented by $R^1$ or $R^2$ are in particular the furyl and the pyridyl group.

In a preferred embodiment, the amino-1,2,4-triazole corresponds to one of the following formulae II and III:

II

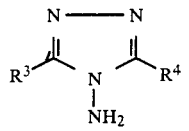

III

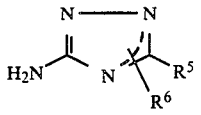

wherein $R^3$ and $R^4$, which may be identical or different, denote H, $NH_2$, alkyl, aryl or alkylthio;

$R^5$ denotes a group such as $R^4$ or SH, $R^6$ denotes H, alkyl, aryl or X—$R^7$, X denotes CO, CS or $SO_2$, and $R^7$ denotes alkyl, alkenyl, cycloalkyl, aryl or an amino group.

Suitable examples of amino-1,2,4-triazoles (AT) used according to the invention are shown below:

AT-1

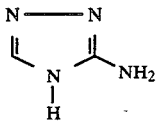

AT-2

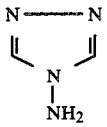

AT-3

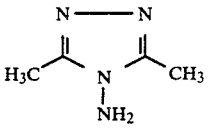

AT-4

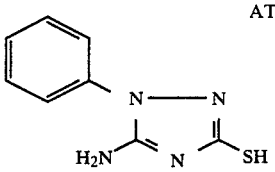

AT-5

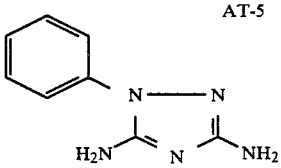

AT-6

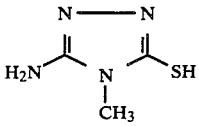

AT-7

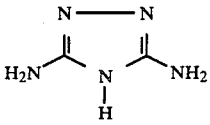

AT-8

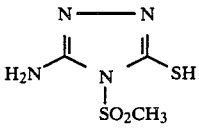

AT-9

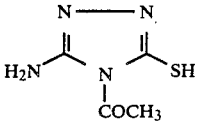

AT-10

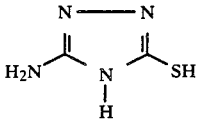

AT-11

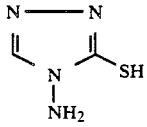

AT-12

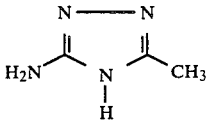

-continued

AT-13

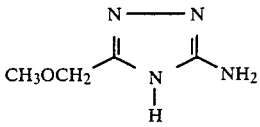

AT-14

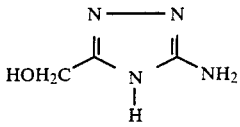

AT-15

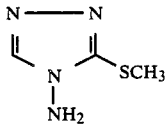

AT-16

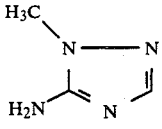

AT-17

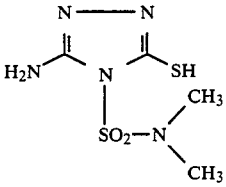

AT-18

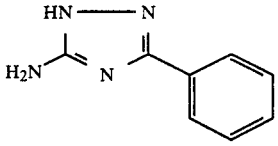

The amino-1,2,4-triazoles used according to the invention are known. A summary of their preparation, physical properties and tautomeric ratios is given in The Chemistry of Heterocyclic Compounds, John Wiley and Sons, New York, Volume 37, 1981.

The after-treatment bath to be used in the stabilizing process according to the invention consists in the simplest case of a solution of the stabilizing compounds. Aqueous solutions are preferred but solutions in organic solvents or in solvent mixtures of water and organic solvents such as aliphatic alcohols, dimethylformamide or the like may also be used.

The concentration of stabilizing compounds in the after-treatment bath may vary within wide limits and depends on the activity of the particular amino-1,2,4-triazole, the material to be stabilized and the effect desired. Quantities of from 0.5 to 50 g per liter have generally proved to be suitable. The optimum concentration for any individual case may easily be determined by routine tests.

The process according to the invention is applicable in the widest possible range to photographic silver images, regardless of the particular method by which they have been produced. Thus, for example, it may be employed for the stabilization of silver images which have been produced by conventional methods of development and fixing of an exposed photographic material. The silver image may be a conventional continuous tone image or an office copy or a microfilm. The process according to the invention may also be employed for stabilizing copies produced by the silver salt diffusion process.

The stabilizing process according to the invention is applied to finished silver images, i.e. silver images which have been obtained photographically by the development of a photographic recording material containing silver halide which has been exposed imagewise. The photographic process carried out after development may include a stabilizing treatment stage in which unexposed silver halide is completely or partly removed or converted into a light-insensitive form.

Such a stabilizing treatment stage may consist, for example, in subjecting the developed photographic recording material which already contains the silver image but also contains residues of silver halide to a conventional process of fixing, e.g. in a processing bath containing an alkali metal thiosulphate or ammonium thiosulphate so that the silver halide is dissolved out of the recording material as a soluble silver complex salt. A so-called "stable" silver image is thereby produced. This stability is due to the virtual absence of light-sensitive silver halide in the unexposed areas, and this image is referred to in the present context as the finished silver image.

The stabilizing process according to the invention is to be distinguished from the stabilizing treatment stage described above. Whereas the latter serves to remove or convert any residues of silver halide present, the stabilizing process according to the present invention comes into play when the silver image is already virtually free from light-sensitive silver halide. The finished silver image which is treated by the stabilizing process according to the invention may, as already mentioned, consist of a silver image which has been produced by the silver salt diffusion process. Such a silver image may have been produced in a separate image receptor layer which may contain silver precipitation nuclei but does not contain any silver halide.

The after-treatment bath according to the invention therefore need not contain any substances for removing residual silver halide.

The after-treatment bath according to the invention may contain other additives in addition to the amino triazole compounds, e.g. wetting agents, pH-modifying agents and anti-oxidizing agents such as alkali metal sulphites or a hydroxylamine salt.

The silver image, which may have been produced by any photographic method, is stabilized by the after-treatment bath according to the invention so that it is rendered less sensitive to external influences when subsequently stored, especially to the influence of oxidizing gases. The stabilizing effect produced is largely independent of the nature of the particular photographic recording material used for producing the silver image, provided it contains at least one light-sensitive silver halide emulsion layer and is developed by any available black-and-white development process.

The halide of the light-sensitive silver halide emulsions used in the recording material may consist of chloride, bromide, iodide or mixtures thereof. In a preferred embodiment, the halide of at least one layer is composed of 0 to 12 mol-% of iodide, 0 to 50 mol-% of chloride and 50 to 100 mol-% of bromide. The halides are generally present predominantly as compact crystals which may for example have cubic, octahedral or transitional forms. They may be characterised by their thickness, which is generally greater than 0.2 μm. The average ratio of diameter to thickness is preferably less than 8:1, the diameter of a grain being defined as the diameter of a circle equal in area to the projected area of the grain. According to another preferred embodiment, all or some of the emulsions may contain mainly tabular silver halide crystals in which the ratio of diameter to thickness is greater than 8:1. The emulsions may be monodisperse or heterodisperse emulsions preferably having an average grain size of from 0.3 μm to 1.2 μm. The silver halide grains may have a layered grain structure.

The usual hydrophilic film forming agents may be used as protective colloids or binders for the layers of the recording material, e.g. proteins, in particular gelatine, but these may be partly or completely replaced by other natural or synthetic binders. Casting auxiliaries and softeners may be used: see Research Disclosure 17 643 (December 1978) in particular Chapters IX, XI and XII.

The emulsions may be chemically and/or spectrally sensitized in the usual manner. They may contain silver halide stabilizers and the emulsion layers as well as other, light-insensitive layers may be hardened with known hardeners in the usual manner. Suitable chemical sensitizers, spectral sensitizing dyes, stabilizers and hardeners are described, for example, in Research Disclosure 17 643, see in particular Chapters III, IV, VI and X.

The recording materials which are subjected to the stabilizing process according to the invention are exposed imagewise to ultraviolet, visible or infra-red light or to high energy radiation. They are then processed in the usual manner to convert the exposed silver halide into image silver by treating the recording material with a silver halide developer compound which may be present in one of the layers of the material or contained in an aqueous treatment bath, this treatment being generally carried out in an alkaline medium. Both inorganic and organic developer compounds may be used, e.g. hydroquinone, 3-pyrazolidone, aminophenol or derivatives thereof: see Research Disclosure 17 643, Chapter XX. Development is generally followed by treatment in a fixing bath to dissolve out any unexposed and undeveloped silver halide from the recording material.

Although the stabilizing process according to the invention may be carried out at any time after development and production of the silver image, it is most effective when carried out as the last treatment step before the black-and-white image is dried. This also means that the stabilizing bath according to the invention is advantageously not followed by any other liquid treatment and especially not by washing. In fact, the stabilizing bath according to the invention is used as an after-treatment or final bath.

Various methods have been developed for assessing the stability of silver images against external influences, in particular those influences leading to the formation of microspot defects in photographic recording materials, and for evaluating these defects. According to one useful test method, the after-treated, dried black-and-white material is exposed to a very dilute hydrogen peroxide atmosphere at an adjusted relative humidity of 84%. This hydrogen peroxide atmosphere is produced by hydrolysis of sodium percarbonate $Na_2CO_3.3H_2O_2$ at 84% relative humidity and room temperature (22°–24° C.). The relative humidity is adjusted to 84% by means of a saturated KBr solution. The exposed and processed paper strips are suspended vertically in a rectangular glass vessel having a capacity of about 20 l. The glass vessel is placed in a temperature controlled water bath to adjust the temperature inside the vessel to 22°–24° C. and the vessel is closed with an opaque glass plate. The samples to be investigated are exposed to a fluorescent lamp (Xenon lamp 22 Watt) through this glass plate at a distance of about 20 cm. About 50 g of percarbonate are uniformly distributed over the bottom of the glass vessel.

EXAMPLE

Various samples of an exposed, developed, fixed and thoroughly washed photographic black-and-white material were washed and then bathed for 3 minutes in a substantially 1% solution of one of the compounds shown in the Table below. In each test, the dried samples were left in the glass vessel until at least one of the samples had been heavily attacked by the contents on the basis of the following scale:

Attack:

none: No visible microspot defects slight: slight microspot defects predominantly at low density moderate: moderate microspot defects at low or high density heavy: pronounced microspot defects at low and high density.

The results and effects of the various compounds are summarized in the Table below.

The soluble and colourless silver compounds formed as a result of destruction of the silver image are rendered insoluble by the stabilizer bath according to the invention. It has surprisingly been found, as may be seen from the Table, that the claimed amino-1,2,4-triazoles according to the invention are very much more effective than the stabilizer compounds not according to the invention (V) which were also tested for comparison.

An additional mercapto group present slightly reduces the effect, as found, for example, in the case of compounds AT-6, AT-10 and AT-11. 1,2,4-Triazoles not containing an amino group are virtually ineffective, see Compound V-1.

Amino compounds of other heterocyclic compounds, e.g. the compounds V-3, V-4, V-5, V-6 and V-8 also fail to produce a stabilizing effect.

The following compounds were also tested for comparison:

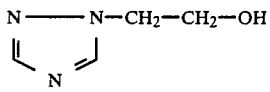

V-1

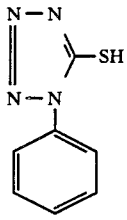

V-2

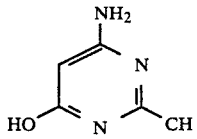

V-3

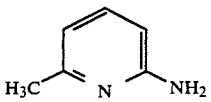

V-4

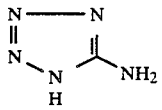

V-5

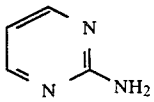

V-6

-continued

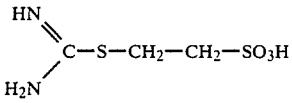

V-7 according to US-A-4 500 632

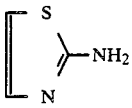

V-8

KSCN

V-9 according to DE-A-22 18 357

TABLE

| Compound | Duration of test in weeks | Formation of microspots |
|---|---|---|
| AT-1 3% | 9 | none |
| AT-2 5% | 9 | moderate at high density |
| AT-6 1% | 3 | slight |
| AT-7 1% | 3 | none |
| AT-10 1% | 3 | slight |
| AT-11 1% | 3 | slight |
| AT.12 1% | 3 | none |
| AT.18 1% | 3 | none |
| V-1 1% | 3 | severe |
| V-2 1% | 3 | severe |
| V-3 1% | 3 | severe |
| V-4 1% | 3 | severe |
| V-5 1% | 3 | severe at low density |
| V-6 1% | 3 | severe |
| V-8 1% | 3 | severe |
| V-7 1% | 9 | moderate at high density |
| V-9 1% | 9 | moderate at low density severe at high density |
| no after-treatment bath | 9 | very severe |

We claim:

1. Process for the stabilization of a photographically produced silver image by treatment of the finished silver image with an after-treatment bath, characterised in that the after-treatment bath contains an amino-1,2,4-triazole.

2. Process according to claim 1, characterised in that the amino-1,2,4-triazole corresponds to the following formula I:

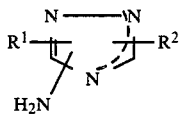

I wherein $R^1$ and $R^2$ which may be identical or different denote H, $NH_2$, alkyl, alkenyl, cycloalkyl, aryl, alkoxy, alkylthio, alkylsulphonyl, sulphamoyl, acyl, SH or a heterocyclic group.

3. Process according to claim 1, characterised in that the amino-1,2,4-triazole corresponds to one of the following formulae II and III:

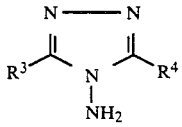

II

-continued

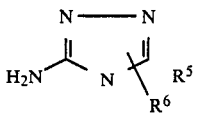

III wherein $R^3$ and $R^4$ which may be identical or different denote H, $NH_2$, alkyl, aryl or alkylthio;

$R^5$ denotes a group such as $R^4$ or SH;

$R^6$ denotes H, alkyl, aryl or X—$R^7$;

X denotes CO, CS or $SO_2$; and $R^7$ denotes alkyl, alkenyl, cycloalkyl, aryl or an amino group.

4. Process according to claims 1, 2 or 3, characterised in that the amino-1,2,4-triazole is contained in an aqueous after-treatment bath in a quantity of 0.5–50 g per liter.

* * * * *